United States Patent [19]

Morgan

[11] 4,205,440

[45] Jun. 3, 1980

[54] PACKAGE OPENER ARRANGEMENT

[76] Inventor: Jerry A. Morgan, 7362 Pegasus Way, San Jose, Calif. 95139

[21] Appl. No.: 964,290

[22] Filed: Nov. 28, 1978

[51] Int. Cl.[2] ..... B26B 29/00

[52] U.S. Cl. ..... 30/287; 30/2; 30/294

[58] Field of Search ..... 30/287, 294, 2

[56] References Cited

U.S. PATENT DOCUMENTS

| | | | |
|---|---|---|---|
| 1,616,040 | 2/1927 | Gulliver | 30/287 |
| 2,178,790 | 11/1939 | Henry | 30/2 |
| 2,187,590 | 1/1940 | Lurie | 30/294 |
| 2,263,353 | 11/1941 | Eidam | 30/2 |
| 2,282,697 | 5/1942 | Bates | 30/294 |
| 2,896,318 | 7/1959 | Brown | 30/2 |
| 4,038,746 | 8/1977 | Bromley | 30/2 |

FOREIGN PATENT DOCUMENTS

| | | | |
|---|---|---|---|
| 1254796 | 1/1961 | France | 30/2 |

*Primary Examiner*—Othell M. Simpson
*Assistant Examiner*—J. T. Zatarga
*Attorney, Agent, or Firm*—Don B. Finkelstein

[57] ABSTRACT

A package opening arrangement comprised of a body member having a lower portion and an upper portion spaced a predetermined distance therefrom and an end portion coupling first ends of the upper portion and the lower portion together. The upper portion overlies the lower portion and a section thereof is substantially co-extensive with the lower portion. The second end of the upper portion is provided with a package cutting means which may be a point. Limit means are provided on the lower portion for limiting the insertion of the second end of the upper portion into the package to be opened.

5 Claims, 3 Drawing Figures

PACKAGE OPENER ARRANGEMENT

BACKGROUND OF THE INVENTION

1. Field of the Invention

This invention relates to the package opening art, and, more particularly, to an improved inexpensive cutter for slicing open sealed packages.

2. Description of the Prior Art

The development of new packaging materials, such as, for example, thin film plastics and new techniques for applying such new materials to various types of packages, such as, for example, cellophane shrink fit and heat seal of thin film plastics, has enabled the packaging industry to provide a comparatively inexpensive outer covering to many types of packages. The covering is transparent so the contents thereof may be seen, is comparatively tough and abrasive-resistant to resist normal wear and tear, to minimize damaging the contents of the package and comparatively close-fitting around the package. Such packaging arrangements have many advantages. For example, they tend to reduce breakage of the contents of the package, they provide an attractive looking outer covering which still lets the contents be seen, and, because of the toughness of such films, tends to prevent either employee theft or shoplifting of the contents of the package. That is, the thin film plastics have proven to be comparatively difficult to tear open surreptitiously to allow the contents to be removed. While such tough, thin film plastic coverings are beneficial to the manufacturer, distributor and retailer, for the reasons above noted, they have often proven to be very inconvenient to open by the ultimate retail purchaser.

Such packaging is, as noted above, difficult to tear open and, in general, requires some form of a pointed or bladed tool such as a knife or the like to provide an initial cut or tear in the thin film plastic. However, many people, including comparatively young people and comparatively old people have difficulty in inserting conventional knives, scissor-blades, or the like, into such thin film plastic coverings without a high degree of risk of cutting themselves during the operation.

One industry, in particular, that has utilized such close fitting, heat-sealed, thin film plastic outer coverings for their product has been the recording industry, wherein phonograph records, eight track tapes, tape cassettes, and the like, are provided with such an outer covering. In this field, not only has the retail purchaser of such products encountered difficulty in removing the plastic coverings from the products, but also many retailers who must open a plurality of such packages for utilization in their various retail establishments have also encountered such difficulties.

Thus, there has long been a need for a safe, effective and comparatively inexpensive tool for cutting open the outer coverings of various packages, and, in particular, the thin film, close-fitting plastic, or other, outer coverings.

SUMMARY OF THE INVENTION

Accordingly, it is the object of the present invention to provide an improved package-opening arrangement.

There is another object to the present invention to provide an improved package opening arrangement that may be conveniently and safely utilized in opening packages.

There is yet another object to the present invention to provide an improved package opening arrangement for cutting open tough, thin film plastic, or other, coverings on packages.

There is yet another object to the present invention to provide an improved package opening arrangement that may be economically fabricated and has comparatively long operational life.

The above, and other objects to the present invention are achieved, according to a preferred embodiment thereof, by providing a planar body member having a planar lower portion, a planar upper portion overlying part of the planar lower portion and spaced from the lower portion, and an end portion coupling together first ends of each of the upper portion and lower portion. The lower portion has a second end spaced a first pre-selected distance from the first end and the upper portion has a second end spaced a second pre-selected distance from the first end. The second pre-selected distance is less than the first pre-selected distance. The second end of the upper portion is provided with walls defining a package cutting means. The package cutting means may, in preferred embodiment of the present invention, comprise a point and side walls extending from the point to the lateral side edges of the body member to define cutting edges.

Limit means are coupled to the lower portion and are upstanding therefrom towards the upper portion. The limit means are spaced a third pre-selected distance which is less than the second pre-selected distance from the end portion of the body member, and, in the preferred embodiment of the present invention, the point of the package cutting means extends beyond the limit means toward the second end of the lower portion. The limit means may be comprised of a pair of spaced apart stop members and the package cutting means extends therebetween.

Preferably, the entire body member and the limit means are unitarily fabricated from a thin piece of sheet material such as aluminum, hard plastic or the like. In the preferred embodiment of the present invention, the upper portion is resiliently coupled to the lower portion of the body member for a limited resilient movement toward and away from the lower portion about the end portion. Such limited resilient movement allows for convenient and easy adjustment on the improved package opening arrangement in the present invention to any desired thickness of the walls of the package and the covering which is desired to be cut.

DESCRIPTION OF THE PREFERRED EMBODIMENT

The above and other embodiments of the present invention may be more fully understood by the following detailed description, taken together with the accompanying drawing, wherein similar reference of characters refer to similar elements throughout and in which.

DESCRIPTION OF THE PREFERRED EMBODIMENT

Figure 1:
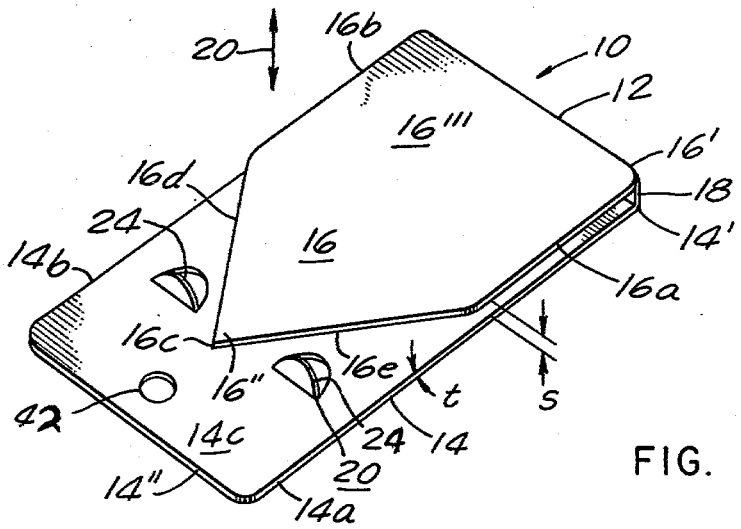
FIG. 1 is a perspective view of a preferred embodiment of the present invention.
Figure 2:
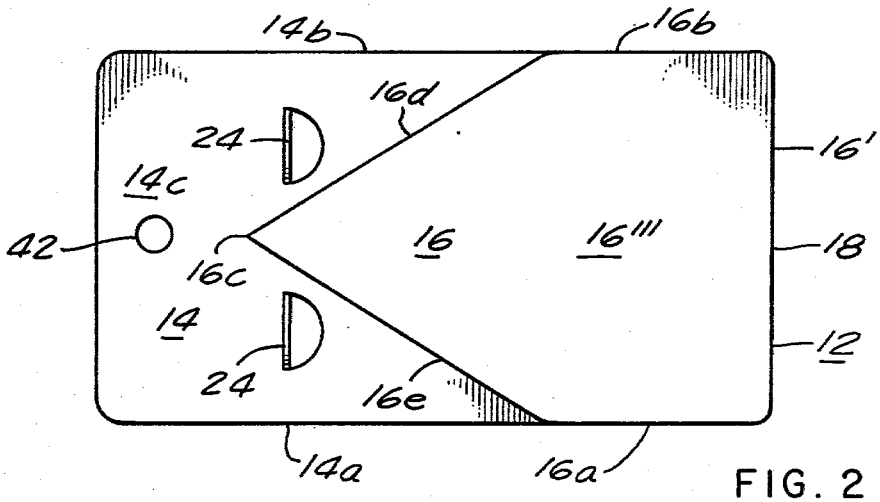
FIG. 2 is a top plan view of the embodiment shown in FIG. 1.

Referring now to the drawing, there is illustrated in FIGS. 1 and 2 a preferred embodiment of the present invention generally designated 10. The embodiment 10 is generally comprised of a body member 12, having a lower portion 14 and an upper portion 16. The upper portion 16 overlies the lower portion 14 and is spaced therefrom. The upper portion 16 is coupled to the lower portion 14 at first ends 16' and 14', respectively, by end portion 18. In the preferred embodiment of the present invention, the coupling of the upper portion 16 to the lower portion 14 by the end portion 18, is a resilient coupling to allow limited resilient movement of the upper portion 16 and lower portion 14 toward and away from each other in the directions indicated by the double ended arrow 20.

The lower portion 14 has a second end 14'' spaced a first pre-selected distance from the first end 14'.

The upper portion 16 has a second end 16'' spaced a second pre-selected distance from the first end 16' and the second pre-selected distance, in the preferred embodiment to the present invention, is less than the first pre-selected distance. The lower portion 14 has a predetermined lateral width between side edges **14*a* and 14*b* thereof. The upper portion 16 has an end section 16''' adjacent the first end 16' having the same lateral distance between the side walls 16*a* and 16*b* as between the side walls 14*a* and 14*b* of the lower portion 14**.

In the embodiment 10 shown in FIGS. 1 and 2, the second end 16'' of the upper portion 16 has wall portions defining a package cutting means which, as illustrated, comprises a point **16*c* defined by the wall portions 16*d* and 16*e*, extending from the portion 16''', and the wall portions 16*d* and 16*e*** define cutting edges.

Limit means, generally designated 20, are coupled to the lower portion 14 and are upstanding therefrom in the direction of the upper portion 16. In the embodiment 10, shown in FIGS. 1 and 2, the limit means 20 comprise a pair of stop members 24 which are substantially identical and are in spaced apart relationship so that the second end 16'' of the upper portion 16 extends therebetween. Thus, the limit means 20 is spaced a third pre-selected distance from end wall 18 and the third pre-selected distance is less than the second pre-selected distance.

In the preferred embodiment 10, the entire body portion 12 and the limit means 20 are unitarily fabricated. For example, it may be a hard plastic molding, or fabricated from comparatively thin sheet aluminum. It has been found that, when thin sheet aluminum is utilized, the thickness of the body member 12 indicated by the letter "t" in FIG. 1, may be on the order of 1/64th of an inch to $\frac{1}{8}$th of an inch, and the spacing between the upper portion 16 and lower portion 14 of the body member 12 indicated by the letter "s" on FIG. 1 may be on the order of 1/32nd of an inch, although greater or less values for both the spacing and the thickness may be utilized as desired in various applications.

The limit means 20, comprised of the two stop members 24, may, when the body member 12 is fabricated from sheet aluminum, be semi-circular punch-outs extending upwardly from the lower portion 14 of the body member 12. The lateral width between the walls **14*a* and 14*b* of the lower portion 14 of the body member 12 may be on the order of $1\frac{1}{4}$ inches, the first pre-selected distance comprising the distance between the first end 14' and second end 14'' of the lower portion 14 may be on the order of $2\frac{1}{4}$ inches, the second pre-selected distance from the first end 16' of the upper portion 16 to the point 16*c* may be on the order of $1\frac{3}{4}$ inches and the third pre-selected distance from the end portion 18 to the limit means 20** may be on the order of $1\frac{1}{2}$ inches.

Figure 3:
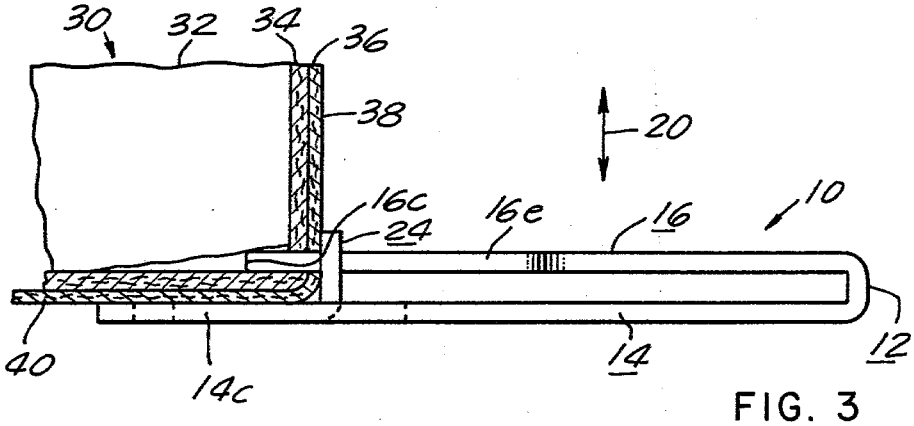
FIG. 3 is a side view of the embodiment shown in FIGS. 1 and 2, illustrating the opening of a package.

FIG. 3 illustrates utilization of the embodiment 10 in opening a package generally designated 30. The package 30 has contents 32 surrounded by, for example, a cardboard box 34 which is covered by a tight fitting thin sheet tough plastic 36.

As shown in FIG. 3, the package 30, which may have an end wall generally designated by the number 38 and a side wall generally designated by the number 40, may be placed adjacent the package opening arrangement 10 so that the end wall 38 abuts against the stop members 24 while the side wall 40 rests against the support section **14*c* of the lower portion 14 of body member 12. The point 16*c* of the upper portion 16 is forced through the plastic coating 36, and, if desired, through the cardboard as well. The package opening arrangement 10 may then be moved laterally in a direction perpendicular to the plane of the paper to slice open the plastic wrap 36 and/or the cardboard 34. It will be appreciated, however, that in many embodiments and applications of the present invention, only the plastic wrap 36 is cut. During the above mentioned lateral movement in a plane perpendicular to the plane of the paper, the side edges 16*d* and 16*e* of the upper portion 16 provide a cutting portion after the point 16*c* has punctured the plastic wrap 36**.

Further, it can be seen that the above mentioned limited resilient movement in a direction indicated by the arrow 20 is desirable to adjust to different thicknesses of plastic wrap and/or cardboard.

If desired, an aperture 42 may be provided in the lower portion 14 in regions adjacent to second end 14'' thereof. The aperture 42, when so provided, allows a convenient location for insertion of a hook, string or the like for holding the package opening arrangement 10.

This concludes the description of the preferred embodiments of the present invention. It will be appreciated that those skilled in the art may find many variations and adaptations thereof and also variations and adaptations falling within the true scope and spirit of the invention are intended to be covered by the appended claims.

I claim:

1. An improved package opening arrangement comprising, in combination:

a unitarily fabricated member having:

a planar lower portion, a planar upper portion overlying and spaced from said lower portion, and an end portion resiliently coupling a first end of said lower portion to a first end of said upper portion to allow limited resilient movement of said first portion and said second portion toward and away from each other;

said lower portion having:

a second end spaced a first predetermined distance from said first end thereof;

said upper portion having:

a second end spaced a second predetermined distance from said first end thereof, and said second predetermined distance being less than said first predetermined distance, and said second end of said upper portion having wall portions defining a package cutting means, and said package cutting means comprising a point;

limit means on said lower portion spaced a third predetermined distance from said first end thereof, and said third predetermined distance being less than said second predetermined distance; and said limit means on said lower portion further comprises:

a pair of stop members in spaced apart relationship upstanding from said lower portion toward said upper portion; and said point of said package cutting means extends between said pair of stop members and free of contact therewith; and each of said pair of stop members comprising punch-outs from said planar lower portion.

2. The arrangement defined in claim 1 wherein:

said unitarily fabricated body member is fabricated from sheet aluminum having a thickness in the range of 1/64th of an inch to ⅛th of an inch, said first predetermined distance is on the order of 2¼ inches, said second predetermined distance is on the order of 1¾ inches, said third predetermined distance is on the order of 1½ inches and said spacing of said upper portion from said lower portion is on the order of 1/32th of an inch at said first ends thereof.

3. The arrangement defined in claim 2 wherein:

said lower portion has a substantially constant predetermined width between said first and said second ends thereof, and said upper portion has a section thereof adjacent said first end thereof having said predetermined width.

4. The arrangement defined in claim 3 wherein said substantially constant predetermined width is on the order of 1¼ inches.

5. The arrangment defined in claim 4 wherein:

said lower portion further comprises walls in regions adjacent said second end thereof. defining an aperture therethrough.

* * * * *